US011108154B2

(12) United States Patent
Litteer

(10) Patent No.: US 11,108,154 B2
(45) Date of Patent: Aug. 31, 2021

(54) COMPACT ANTENNA PHASE SHIFTER WITH SIMPLIFIED DRIVE MECHANISM

(71) Applicant: John Mezzalingua Associates, LLC, Liverpool, NY (US)

(72) Inventor: Andrew Litteer, Clay, NY (US)

(73) Assignee: JOHN MEZZALINGUA ASSOCIATES, LLC, Liverpool, NY (US)

( * ) Notice: Subject to any disclaimer, the term of this patent is extended or adjusted under 35 U.S.C. 154(b) by 0 days.

(21) Appl. No.: 17/045,379

(22) PCT Filed: Apr. 23, 2019

(86) PCT No.: PCT/US2019/028702
§ 371 (c)(1),
(2) Date: Oct. 5, 2020

(87) PCT Pub. No.: WO2019/209815
PCT Pub. Date: Oct. 31, 2019

(65) Prior Publication Data

US 2021/0151879 A1 May 20, 2021

Related U.S. Application Data

(60) Provisional application No. 62/661,230, filed on Apr. 23, 2018.

(51) Int. Cl.
*H01Q 3/32* (2006.01)
*H01Q 3/36* (2006.01)
(Continued)

(52) U.S. Cl.
CPC ..... *H01Q 3/32* (2013.01); *H01Q 21/205* (2013.01); *H01Q 1/246* (2013.01)

(58) Field of Classification Search
CPC ..... H01Q 3/32; H01Q 3/36; H01Q 21/20; H01Q 21/205; H01P 1/184; H01P 1/18
See application file for complete search history.

(56) References Cited

U.S. PATENT DOCUMENTS 7,170,466 B2 * 1/2007 Janoschka ..... H01P 1/184 333/156
10,424,839 B2 * 9/2019 Li ..... H01P 1/184
(Continued)

FOREIGN PATENT DOCUMENTS

CN 206180085 U 5/2017
KR 1020100109761 A 10/2010
KR 101729035 B1 4/2017

OTHER PUBLICATIONS

International Searching Authority, International Search Report and Written Opinion, Completed: Sep. 27, 2019, dated Sep. 27, 2019 (7 pages).

*Primary Examiner* — Tho G Phan
(74) *Attorney, Agent, or Firm* — Barclay Damon LLP

(57) ABSTRACT

Disclosed is a phase shifter arrangement for an antenna, such as a cellular antenna, that has a simplified drive mechanism. The phase shifter arrangement has two phase shifters, each with two wiper arms that are coupled at one end to a single drive shaft. Each of the wiper arms have a pivot access that may be located at or near its center such that as the drive shaft translates, it mechanically engages both wiper arms, causing them to rotate around their respective pivot axes. Certain antenna arrangements have several array faces. For example, the antenna may have three array faces, each spaced at 120 degrees of azimuth. The drive shafts for each of these array faces may operate independently to function as a multisector antenna, or they may be driven in unison to function as an omnidirectional antenna.

18 Claims, 7 Drawing Sheets

(51) Int. Cl.
*H01Q 21/20* (2006.01)
*H01Q 1/24* (2006.01)

(56) References Cited

U.S. PATENT DOCUMENTS

| | | | | |
|---|---|---|---|---|
| 10,581,163 | B2 * | 3/2020 | Schmutzler | H01Q 3/005 |
| 10,833,407 | B2 * | 11/2020 | Yang | H01Q 1/246 |
| 10,854,967 | B2 * | 12/2020 | Zimmerman | H01Q 3/06 |
| 2005/0046514 | A1 | 3/2005 | Janoschka | |
| 2017/0038730 | A1 | 2/2017 | Winkler et al. | |
| 2020/0321697 | A1 * | 10/2020 | Zimmerman | H01Q 21/26 |

* cited by examiner

COMPACT ANTENNA PHASE SHIFTER WITH SIMPLIFIED DRIVE MECHANISM

CROSS REFERENCE TO RELATED DISCLOSURE

This application is based upon and claims priority to, under relevant sections of 35 U.S.C. § 119, U.S. Provisional Patent Application No. 62/661,230, COMPACT ANTENNA PHASE SHIFTER WITH SIMPLIFIED DRIVE MECHANISM filed Apr. 23, 2018, the entire contents of which are hereby incorporated by reference.

BACKGROUND OF THE INVENTION

Field of the Invention

The present invention relates to wireless communications, and more particularly, to small cell antennas incorporating mechanical phase shifters.

Related Art

Urban deployments of cellular network require antennas that are compact and offer a variety of gain profile configurations. A solution to this challenge is a cylindrical antenna having several internal array faces, or sectors, each corresponding to a given azimuthal portion of a 360 degree area of angular coverage. Often, depending upon the coverage area desired, it may be necessary for an antenna to have the ability to tilt its gain downwardly or upwardly. Such gain pattern adjustment is conventionally achieved with phase shifters that may be integrated into each antenna array face.

Conventional phase shifters have wiper arms that are individually engaged at the wiper arm distal end (opposite from the pivot end). This configuration has two principal disadvantages: (1) it increases the materials and number of parts associated with the phase shifter; and (2) it restricts the ability to reduce the size of the array face. The latter complication arises inasmuch as the wiper arms require a drive mechanism that extends to the outer edges of the array face along the azimuth axis. In the case of a small cell antenna, having a cylindrical configuration with three array faces, or sectors, (each oriented at 120 degree intervals, for example), a conventional drive mechanism interferes with the other array face PCBs. This is due to the configuration of the drive mechanism which is disposed at the outer edges of its respective array face. As such, the drive mechanism interferes with the other PCBs, i.e., where they meet.

Accordingly, a need exists for a phase shifter having a minimal profile and part count, enabling mounting of multiple array faces within a cylindrical/sector antenna.

SUMMARY OF THE INVENTION

An aspect of the present invention involves a phase shifter arrangement for an antenna. The phase shifter arrangement has pair of phase shifters, each phase shifter having a first wiper arm and a second wiper arm, the first and second wiper arm each having a proximal end and a distal end and a pivot axis disposed between the proximal end and the distal end. The first and second wiper arm each have a wiper arm conductive trace disposed on its underside wherein the conductive trace is disposed between the pivot axis and the distal end, and a drive pin slot disposed between the pivot axis and the proximal end. The phase shifter arrangement has a drive shaft that has a longitudinal axis and two drive pins, wherein the drive pins are disposed on opposite sides of the drive shaft at a lateral distance from the longitudinal axis of the drive shaft and mechanically coupled to the drive shaft by a plurality of struts. Each of the drive pins mechanically couples to a corresponding first wiper arm and second wiper arm of each of the pair of phase shifters, wherein as the drive shaft translates along the longitudinal axis, each drive pin slides within the drive pin slots of the corresponding first wiper arm and second wiper arm, causing the first wiper arm and second wiper arm to rotate in unison about their corresponding pivot axes.

Another aspect of the present invention involves an antenna that comprises an RF signal input port, a plurality of radiators, and a phase shifter arrangement electrically coupled between the RF signal input port and the plurality of radiators. The phase shifter arrangement has a pair of phase shifters, each phase shifter having a first wiper arm and a second wiper arm. The first and second wiper arm each have a proximal end and a distal end and a pivot axis disposed between the proximal end and the distal end. The first and second wiper arm each have a wiper arm conductive trace disposed on an its underside wherein the conductive trace is disposed between the pivot axis and the distal end, and a drive pin slot disposed between the pivot axis and the proximal end. The phase shifter arrangement has a drive shaft having a longitudinal axis and two drive pins, wherein the drive pins are disposed on opposite sides of the drive shaft at a lateral distance from the longitudinal axis of the drive shaft and mechanically coupled to the drive shaft by a plurality of struts, wherein each of the drive pins mechanically couples to a corresponding first wiper arm and second wiper arm of each of the pair of phase shifters. As the drive shaft translates along the longitudinal axis, each drive pin slides within the drive pin slots of the corresponding first wiper arm and second wiper arm, causing the first wiper arm and second wiper arm to rotate in unison about their corresponding pivot axes.

Another aspect of the invention involves an antenna having a plurality of array faces, each of the plurality of array faces corresponding to a distinct azimuth angle of coverage. Each of the array faces comprises a PCB structure, a plurality of radiators disposed on the PCB structure, and a phase shifter arrangement disposed on the PCB structure. The phase shifter arrangement has a pair of phase shifters, each of the phase shifters electrically coupled between one or more RF signal inputs and the plurality of radiators. Each phase shifter has a first wiper arm and a second wiper arm, the first and second wiper arm each having a proximal end and a distal end and a pivot axis disposed between the proximal end and the distal end. The first and second wiper arm each have a wiper arm conductive trace disposed on an its underside wherein the conductive trace is disposed between the pivot axis and the distal end, and a drive pin slot disposed between the pivot axis and the proximal end. The phase shifter arrangement has a drive shaft having a longitudinal axis and two drive pins, wherein the drive pins are disposed on opposite sides of the drive shaft at a lateral distance from the longitudinal axis of the drive shaft and mechanically coupled to the drive shaft by a plurality of struts, wherein each of the drive pins mechanically couples to a corresponding first wiper arm and second wiper arm of each of the pair of phase shifters. As the drive shaft translates along the longitudinal axis, each drive pin slides within the drive pin slots of the corresponding first wiper arm and second wiper arm, causing the first wiper arm and second wiper arm to rotate in unison about their corresponding pivot axes.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the disclosed subject matter encompasses other embodiments as well. The drawings are not necessarily to scale, emphasis generally being placed upon illustrating the features of certain embodiments of the invention. In the drawings, like numerals are used to indicate like parts throughout the various views.

DETAILED DESCRIPTION

The invention is directed to a phase shifter assembly wherein each wiper arm has a pivot point disposed proximal the center of a wiper arm, and wherein the end opposite the distal end engages with a drive pin. Both wiper arms of the phase shifter engage with a single drive pin and thus are both driven by a single shaft that is coupled to a drive motor.

The phase shifter assembly according to the disclosure requires less material and fewer parts than a conventional phase shifter. Further, because the drive mechanism is located substantially at the center of the phase shifter (along the azimuth axis), there is more room at the outer edges of the array face PCB to enable the shrinking of the array face in the azimuth dimension, enabling a smaller small cell antenna.

Figure 1:
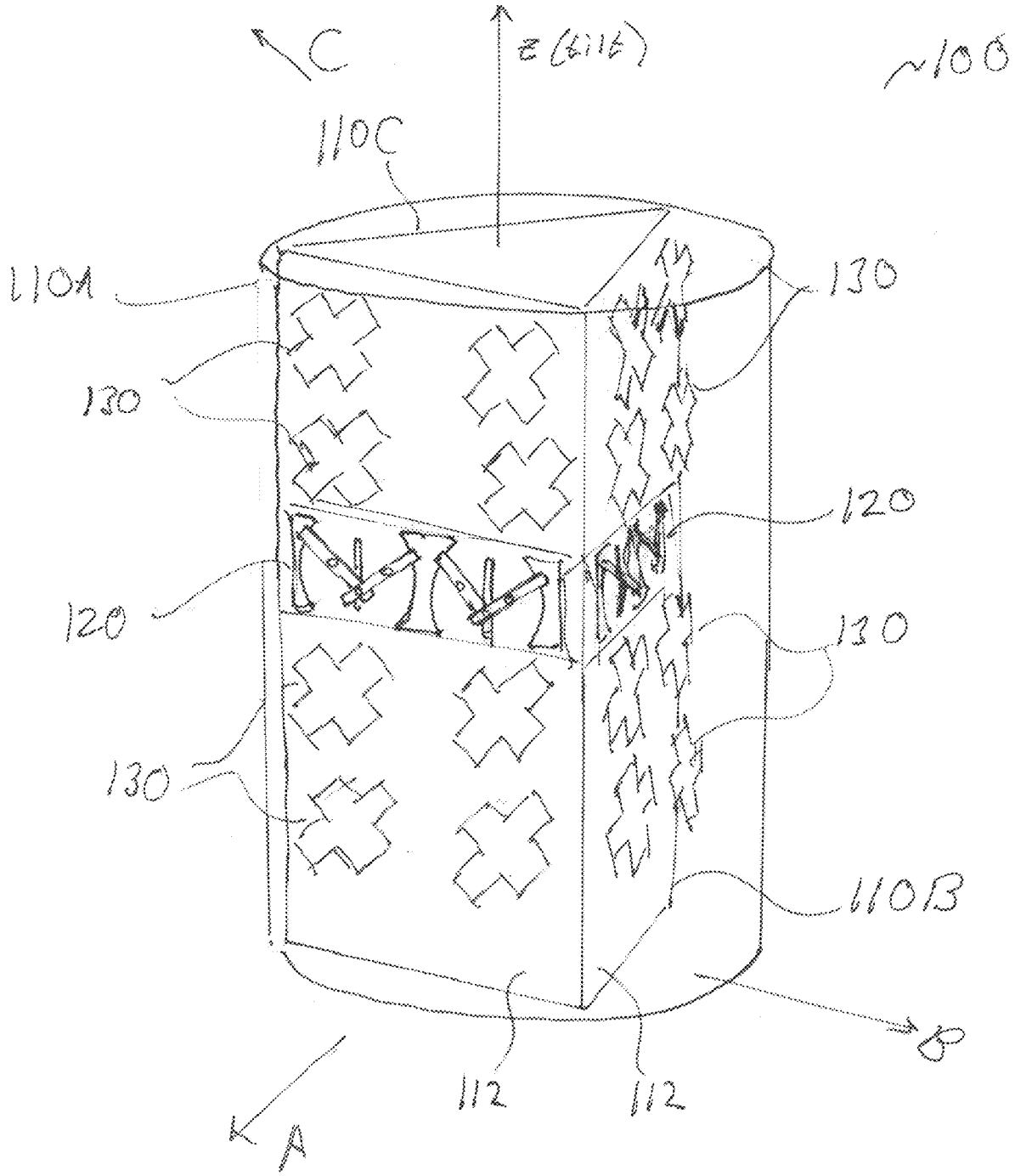
FIG. 1 illustrates an exemplary cylindrical/sector antenna according to the disclosure wherein tri-sector antennas, each spanning one-hundred and twenty degrees of coverage.

FIG. 1 illustrates an exemplary small cell antenna 100. Antenna 100 may have a plurality of array faces 110*a*, 110*b*, and 110*c*, each of which corresponding to an azimuth direction A, B, and C, whereby each array face 110*a*, 110*b*, 110*c* has a gain pattern that substantially covers its corresponding azimuthal portion of 360 degrees. Azimuth directions A, B, and C may each be orthogonal to the surface of their corresponding array faces 110*a*, 110*b*, 110*c*, and each may be orthogonal to the tilt (or vertical) axis z. The exemplary antenna 100 has three array faces, each spaced at 120 degrees, however, it will be understood that variations to this design, including the number and angular orientations of the array faces, are possible and within the scope of the disclosure. For example, each array face may span ninety (90) degrees or sixty (60) degrees.

Each of the array faces 110*a*, 110*b*, 110*c* has a printed circuit board (PCB) structure 112, a plurality of radiators 130, and a phase shifter assembly 120. Each phase shifter assembly 120 provides a differential phase delay to sets of radiators 130 as a function of their location along the tilt axis z. Generally, the radiators 130 located at the center of the array face 110*a/b/c* along the tilt axis (phase center) are not given any phase delay, and rows of radiators 130 are given an increasing differential phase delay as a function of distance from phase center along the tilt axis. The general principles of phase shifters and how they function are generally known in the art.

Among the possible variations to the antenna 100 of the disclosure are two configurations: tri-sector, and omni-directional. For the tri-sector variation, each array face 110*a*, 110*b*, 110*c* operates independently. In the context used herein, the independent operation means that each array face 110*a*, 110*b*, 110*c* has its own RF signals coupled to its corresponding radiators 130, and each phase shifter 120 operates independently. As such, each 120 degree sector operates independently, i.e., is not influenced by the RF signals in the adjacent sectors. In an omni variation, the three array faces 110*a*, 110*b*, 110*c* are unified in that all of the radiators 130 on array faces 110*a*, 110*b*, 110*c* are coupled to the same RF signal sources, and the phase shifters 130 operate in unison.

Figure 2:
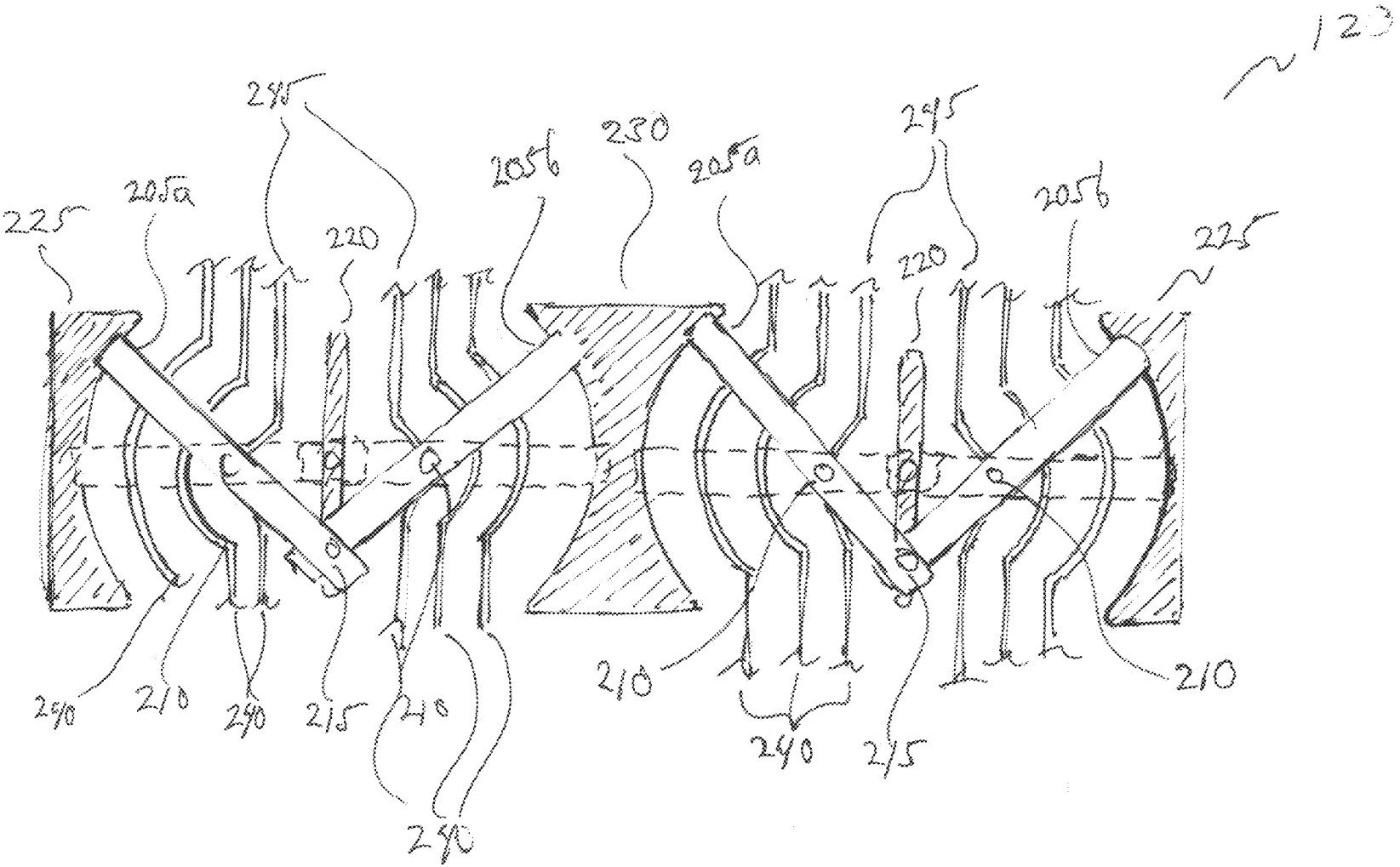
FIG. 2 illustrates an exemplary phase shifter assembly according to the disclosure, as seen from the outward-facing side of an antenna array face.

FIG. 2 illustrates an exemplary phase shifter assembly 120 according to the disclosure, as seen from the outward-facing side of an antenna array face 110 (use of "array face 110" may simply be any or all of the array faces 110*a*, 110*b*, 110*c*). The phase shifter assembly 120 may include two pairs of wiper arms 205*a* and 205*b*, each of which is configured to rotate around their respective axis 210, and are mutually, rotatably, and mechanically coupled by a drive pin 215, which translates within a PCB slot 220. As illustrated, the wiper arms 205*a*, 205*b* are oriented such that drive pin 215 is located at or near the full extent of its motion within PCB slot 220. Further illustrated (in dotted lines) are wiper arms 205*a*, 205*b* with drive pin 215 in its center position within PCB slot 220. Phase shifter assembly 120 further includes PCB openings 225 and 230. PCB openings 225 and 230 which define an arcuate boundary corresponding to the sweep of the wiper arms 205*a*, 205*b* as they rotate in response to translation of the drive pin 215 within the PCB slots 220. Each wiper arm 205*a*, 205*b* has a distal hook portion that mechanically engages with the edge of one of PCB openings 225, 230 (described below).

The phase shifter assembly 120 includes a plurality of a first input/output RF signal trace 24, each of which electrically couple one conductive trace to another conductive trace. For example, the wiper arm 205*a*, 205*b* may electrically couple a first input/output RF signal trace 24 to an second input/output RF signal trace 245.

By placing the axis 210 proximal to the center of each of the wiper arms 205*a*, 205*b*, and by causing the wiper arms 205*a*, 205*b* to engage the drive pin 215 as illustrated, it is possible to drive both wiper arms 205*a*, 205*b* with a single drive mechanism (described below). In contrast, conventional wiper arms 205*a*, 205*b* have their axes at a proximal end, and are driven at their distal end.

Figure 3:
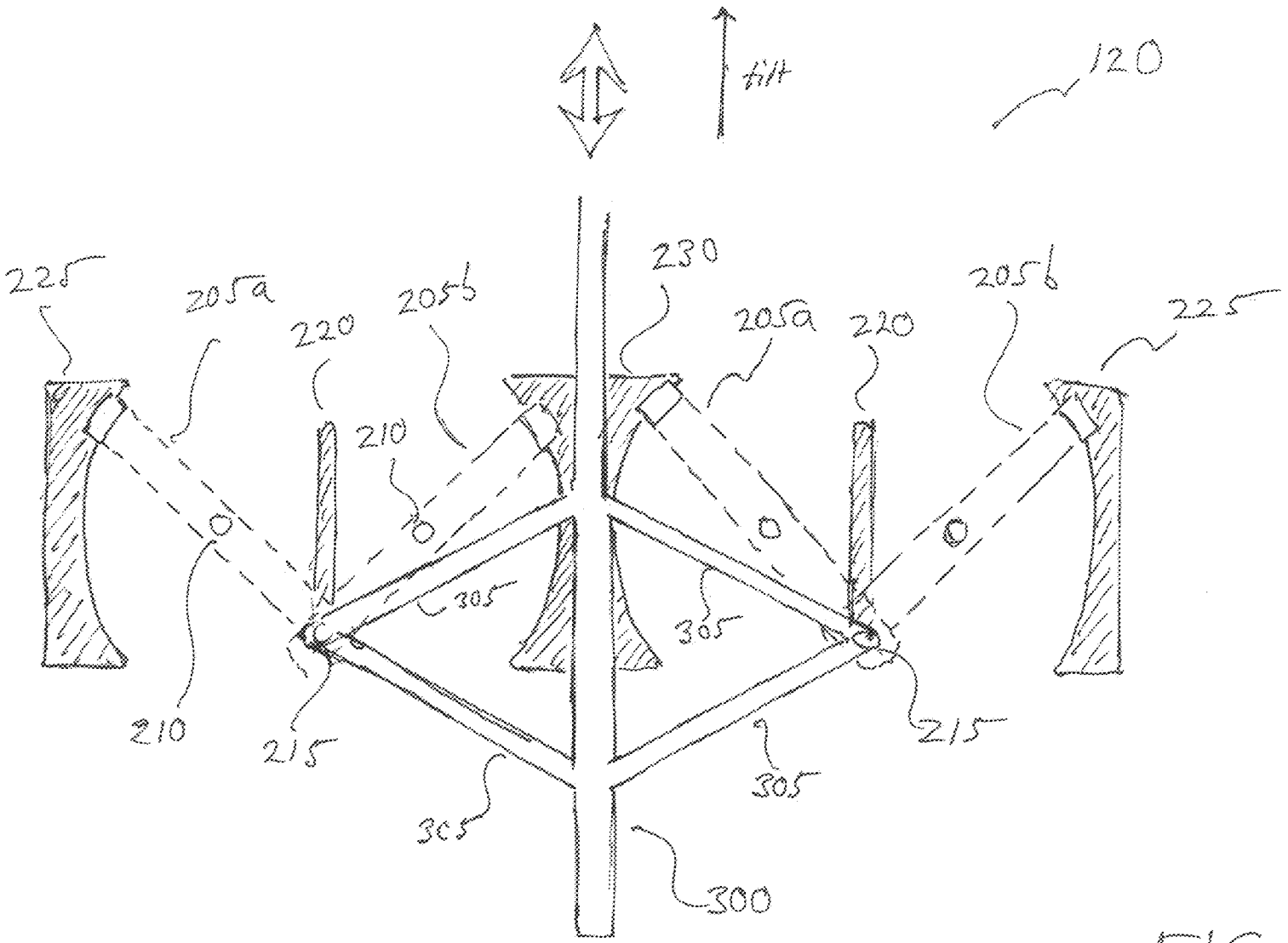
FIG. 3 illustrates an exemplary phase shifter assembly according to the disclosure, as seen from the inward-facing side of an antenna array face.

FIG. 3 illustrates an exemplary phase shifter assembly 120 according to the disclosure, as seen from an inwardly-facing side of an antenna array face 110. Wiper arms 205*a*, 205*b* are illustrated with dotted lines inasmuch as they are disposed on the other side of the PCB. Illustrated is a wiper arm drive shaft 300 that is mechanically coupled to drive pins 215 by support struts 305. Translation along the tilt (or longitudinal) axis, causes the drive shaft 300 to uniformly engage the drive pins 215 in parallel. Accordingly, the drive shaft 300 drives the wiper arms 205*a*, 205*b* in unison within the respective PCB slots 220. As a consequence, the wiper arms 205*a*, 205*b* rotate about the respective pivot points 210.

Figure 4:
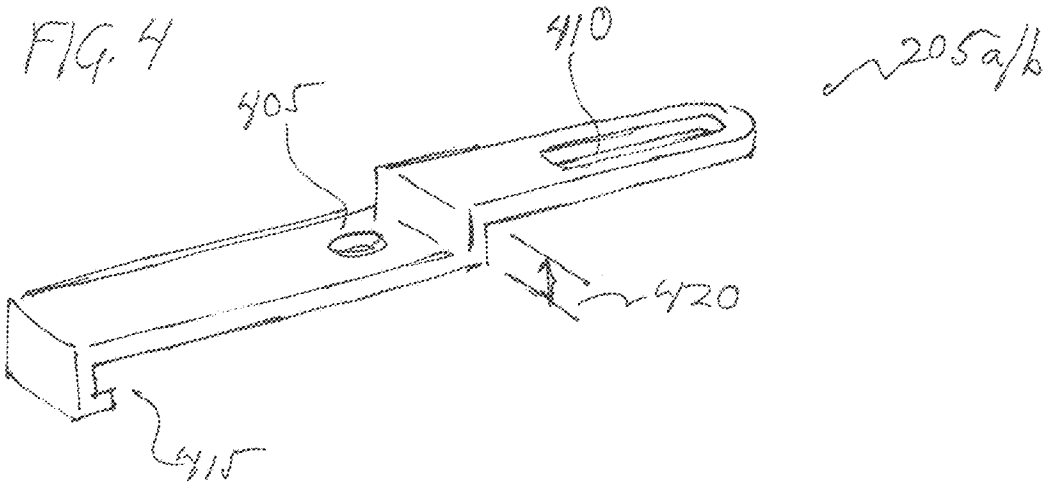
FIG. 4 illustrates an exemplary phase shifter wiper arm according to the disclosure.

FIG. 4 depicts is an isolated perspective view of an exemplary wiper arm 205*a* or 205*b* according to the disclosure. More specifically, and referring to FIGS. 3 and 4, each of wiper arm arms 205*a*, 205*b* has: (i) an aperture 405 for rotating about the pivot axis 210, (ii) a hook or recurved end portion 415 disposed at one end, and (iii) a slot 410 for accepting the drive pin 215 which engages the wiper arms 205*a*, 205*b* as the drive shaft 300 translates with the PCB slot 220. As mentioned hereinabove, the hook or recurved end portion 415 engages an edge of the PCB opening 225, 230 to assure electrical coupling between the wiper arms 205*a*, 205*b* and: (i) a conductive trace, (ii) a first input/output RF signal trace 240, and/or (iii) a second input/output RF signal input trace 245. Each of the wiper arms 205*a*, 205*b* also have a step feature 420, the height of which may vary from one of the wiper arms 205*a*, 205*b* to the other of the wiper arms 205*a*, 205*b*. Such features will become apparent in view of the following detailed discussion in FIG. 5.

Figure 5:
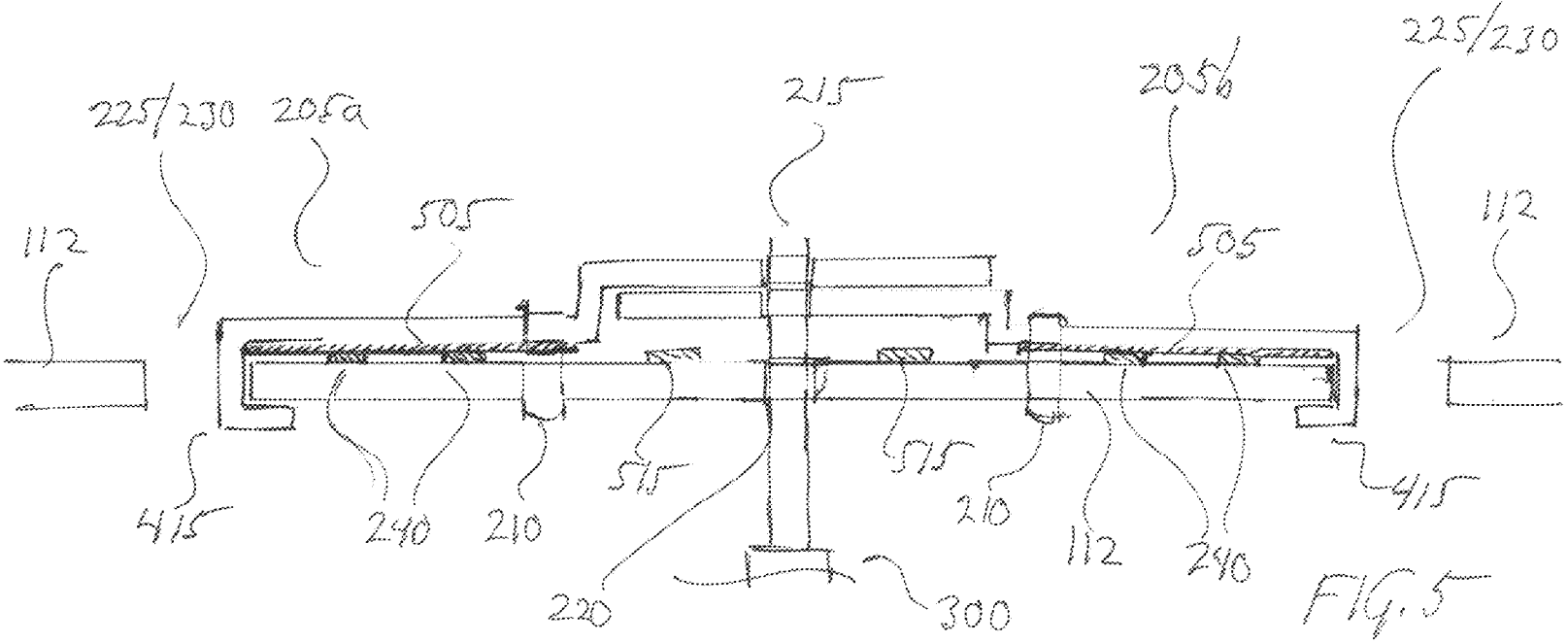
FIG. 5 is an edge view of an array face Printed Circuit Board (PCB) with a single phase shifter pair according to the disclosure.

FIG. 5 is an edge view of an antenna array face and printed circuit board PCB 112 with a wiper arm pair 205*a*, 205*b* according to the disclosure. The illustrated wiper arm pair 205*a*, 205*b* may be either one of the two pairs within wiper arm assembly 120. Illustrated therein are PCB openings 225, 230, shown as gaps in the PCB 112; wiper arms 205*a*, 205*b* (i.e., rotatably coupled to the PCB 112 via axis 210) and translatably coupled to the PCB 112 at an edge of the PCB openings 225, 230 via a distal hook 415. The drive pin 215 is coupled to both wiper arms 205*a*, 205*b* and is translatably disposed within the PCB slot 220.

It will be apparent that the first wiper arm 205*a* and the second wiper arm 205*b* define variable height dimensions with respect to each of their respective step features 420. Firstly, it will be apparent that for both wiper arms 205*a*, 205*b* to engage the drive pin 215, they must necessarily be staggered such that one is superimposed over the other. Secondly, even though the second wiper arm 205*b* is the "lower" of the two wiper arms 205*a*, 205*b* that its portion with drive pin slot 410 is closer to PCB 112 that is the respective portion of wiper arm 205*a*, it continues to, or still, has a step feature. This is due to the fact that it remains desirable to provide distance between the lower of the two wiper arms 205*a*, 205*b* with any of the input/output RF signal traces 515 so as to prevent electrical signal interference with the input/output RF signal traces 515.

Further illustrated in FIG. 5 are wiper arm conductive traces 505 disposed on the underside of wiper arms 205*a*, 205*b*. Wiper arm conductive traces 505 electrically couple with RF signal traces 240, and imparts a phase delay on the RF signal traces, depending on the location of the RF signal trace (distal vs. proximal) and the angular orientation of the wiper arm 205*a/b* around the axis defined by pivot axis 210.

Figure 6A:
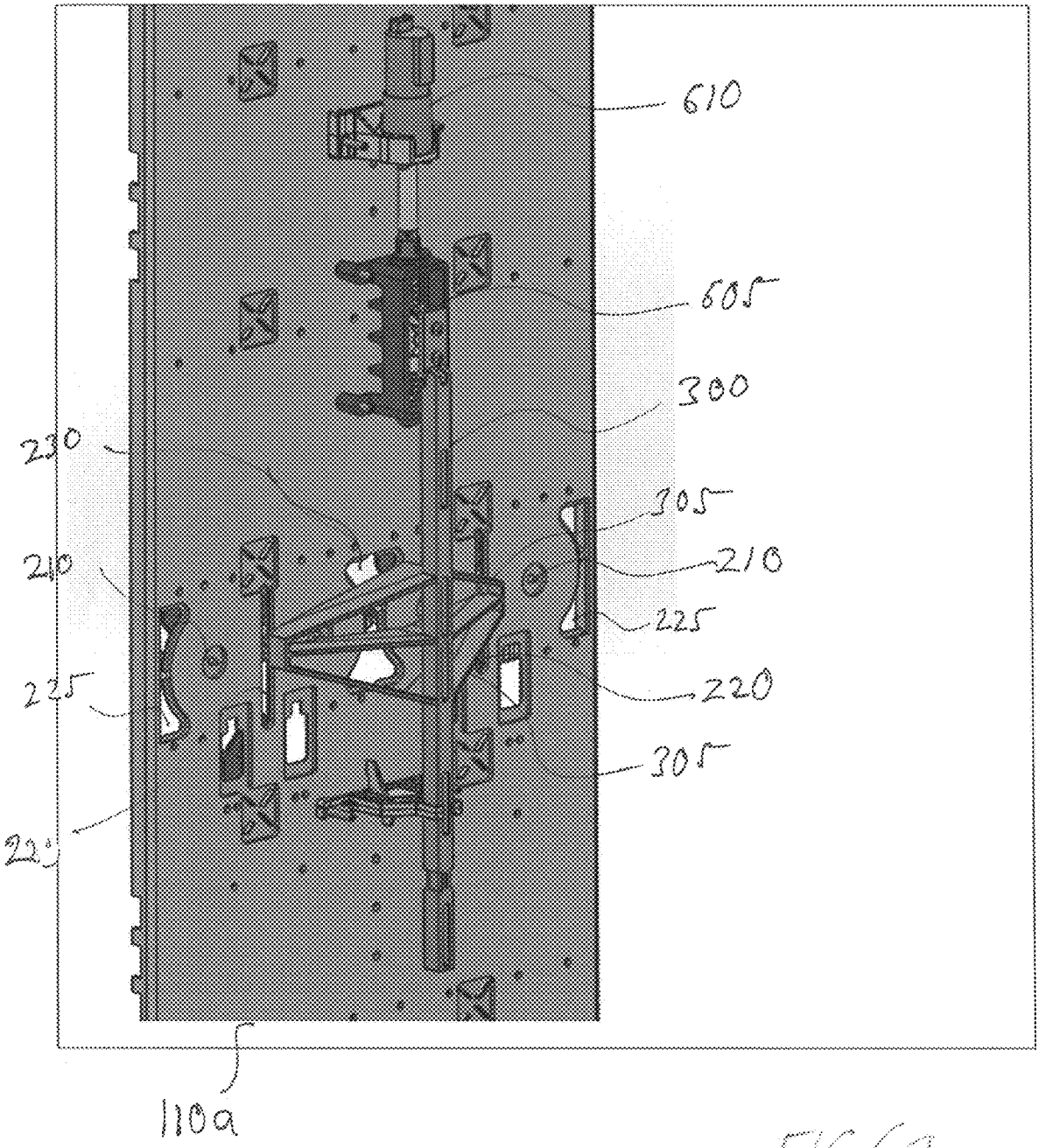
FIG. 6*a* illustrates an internal perspective view of a sector antenna and an independently-driven phase shifter assembly for a single sector thereof.
Figure 7B:
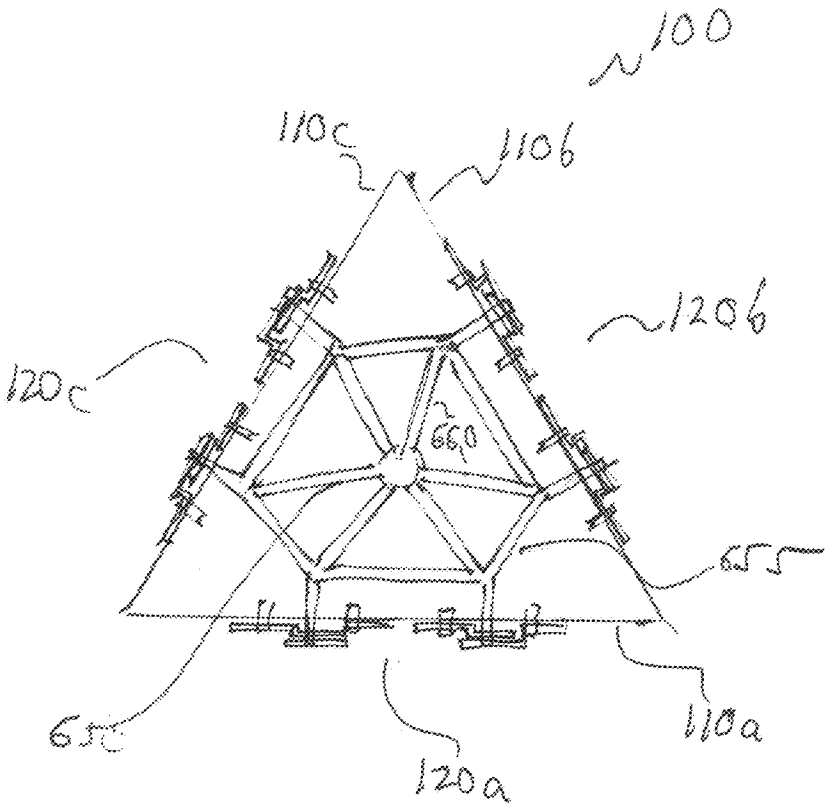
FIG. 7*b* is a top view of the omni-directional sector shown in FIG. 7*b* depicting a vertical shaft/spoked-web for simultaneously driving the phase shifters along all sectors of the omni-directional antenna.
Figure 7A:
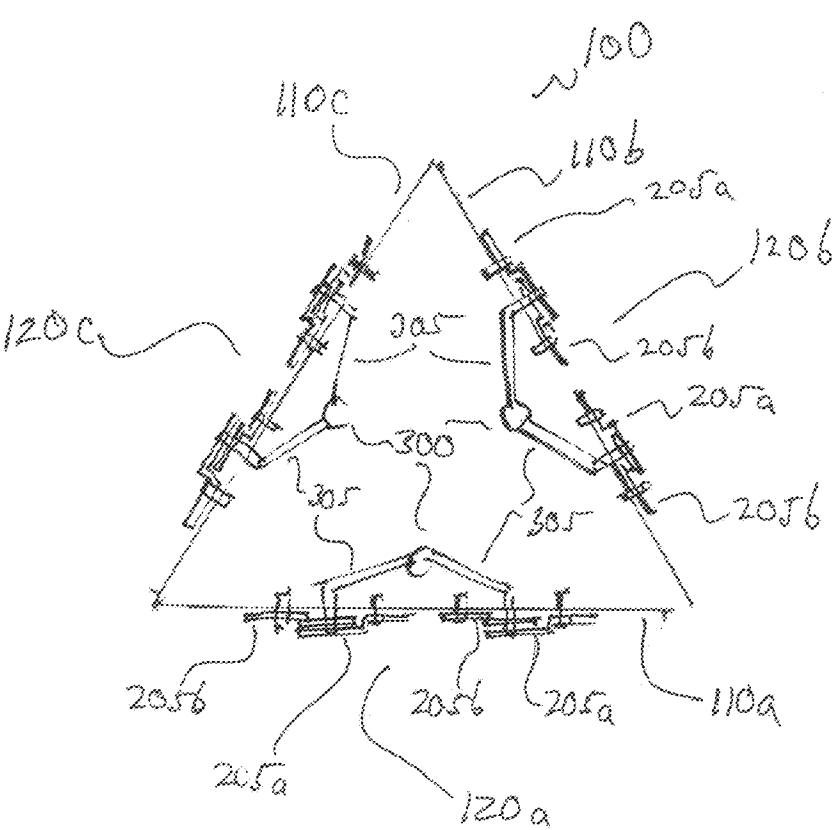
FIG. 7*a* is a top view of the sector antenna shown in FIG. 6*a* depicting tri-sector arrays and an independently-driven phase shifter assembly disposed along the internal face of each sector.

In FIGS. 6*a* and 7*a*, an internal perspective view of a sector antenna 110*a* is depicted. More specifically, an independently-driven phase shifter assembly 120 is provided for a single sector antenna 110*a*. Therein, a wiper arm (obscured by the PCB structure) is displaced and slid along the input/output RF traces by the input drive shaft 300. That is, the wiper arms 205*a*, 205*b* are pivotally coupled to the input drive shaft 300 by the drive pins 215 disposed at the distal ends of a support strut 305. A rotary actuator 610 turns a sector drive shaft 605 which employs a worm gear transmission to covert the rotational motion of the actuator 610 into linear motion along the input drive shaft 300.

Translation along the tilt (or longitudinal) axis, causes the drive shaft 300 to uniformly engage the drive pins 215 in parallel and the wiper arms 205*a*, 205*b* to rotate about the respective pivot points 210. The top view of the sector antenna shown in FIG. 7*a* depicts at least three independently-driven phase shifter assemblies 120, each phase shifter assembly being disposed along the internal face of each sector.

Figure 6B:
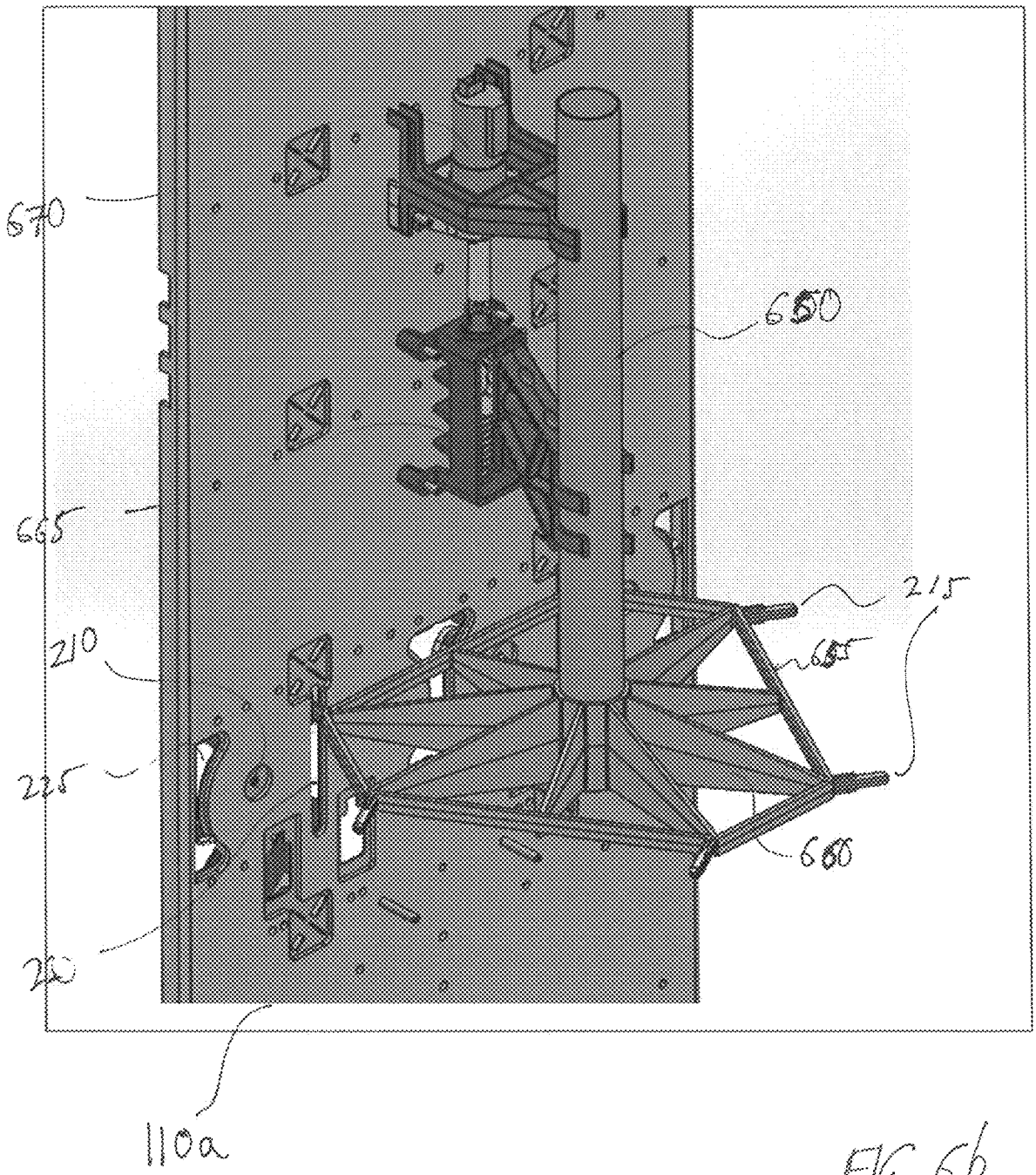
FIG. 6*b* illustrates an internal perspective view of an omni-directional sector antenna and a commonly-driven phase shifter assembly for driving all sectors of the omni-directional antenna.

In FIGS. 6*b* and 7*b*, an internal perspective view of an omni-directional antenna is depicted. More specifically, a plurality of commonly-driven phase shifter assemblies 120*a*, 120*b*, 120*c* are driven in unison by a drive shaft/strut arrangement. Each of the phase shifter assemblies 120*a*, 120*b*, 120*c* is displaced by a combination of a central shaft 650 and a spoked support strut 655, 660. The central shaft 610 is slideably mounted to the back-side of the PCB by a shaft fitting 665 and translates up and down by a rotary actuator 670.

More specifically, a rotary actuator 670 drives a worm gear transmission to covert the rotational motion of the actuator 670 into linear motion along the central input shaft 610. Translation along the tilt (or longitudinal) axis, is effected by the drive shaft 650 which engages and pivots each of the wiper arms 205*a*, 205*b* about each of their respective pivot axes 210. The top view of the omni-directional antenna shown in FIG. 7*a* depicts a plurality of independently-driven phase shifter assemblies 120*a*, 120*b*, 120*c* being displaced by a commonly actuated central shaft 650.

While the instant invention has been shown and described herein in what are conceived to be the most practical and preferred embodiments, it is recognized that departures, modifications, adaptations, variations, and alterations in the described methods and systems may be made and will be apparent to those skilled in the art of the foregoing description which does not depart from the spirit and scope of the invention which is therefore not to be limited to the details herein. For this reason, such changes are desired to be included within the scoped of the appended claims. The descriptive manner which is employed for setting forth the embodiments should be interpreted as illustrative but not limitative of the full scope of the claims which embrace any and all equivalents thereto.

The invention claimed is:

1. A phase shifter arrangement for an antenna, comprising:

a pair of phase shifters, each phase shifter having a first wiper arm and a second wiper arm, the first and second wiper arm each including (i) a proximal end, (ii) a distal end, (iii) a pivot axis disposed between the proximal end and the distal end, and (iv) a drive pin slot disposed between the pivot axis and the proximal end, the first and second wiper arms each having a wiper arm conductive trace disposed on one side thereof, and the conductive trace being disposed between the pivot axis and the distal end, a drive shaft having a longitudinal axis and two drive pins disposed on opposite sides of the drive shaft a lateral distance from the longitudinal axis of the drive shaft and mechanically coupled to the drive shaft by a plurality of elongate struts, wherein one of the drive pins is pivotally mounted to the first wiper arm and another of the drive pins is pivotally mounted to the second wiper arm of each of the pair of phase shifters, and wherein as the drive shaft translates along the longitudinal axis, each drive pin slides within the drive pin slots of the corresponding first and second wiper arms, causing the first and second wiper arms to rotate in unison about their corresponding pivot axes.

2. The phase shifter arrangement of claim 1, wherein each first wiper arm has a first step feature disposed between its pivot axis and its drive pin slot, and each second wiper arm has a second step feature disposed between its pivot axis and its drive pin slot, wherein the second step feature is greater in height than the first step feature.

3. The phase shifter arrangement of claim 1, wherein each pivot axis is disposed substantially at a center of its corresponding first or second wiper arm.

4. The phase shifter arrangement of claim 1, wherein each of the first and second wiper arms comprise a distal hook structure, wherein each distal hook structure engages an edge of a corresponding PCB opening.

5. The phase shifter arrangement of claim 4, wherein each distal hook structure engages the edge of its corresponding PCB opening to apply sufficient pressure to electrically couple its corresponding conductive trace to a one or more phase shifter traces.

6. An antenna, comprising:

an RF signal input port;

a plurality of radiators; and a phase shifter arrangement electrically coupled between the RF signal input port and the plurality of radiators, the phase shifter arrangement having a pair of phase shifters, each phase shifter having a first wiper arm and a second wiper arm, the first and second wiper arm each having a proximal end and a distal end and a pivot axis disposed between the proximal end and the distal end, the first and second wiper arm each having a wiper arm conductive trace disposed on its underside wherein the conductive trace is disposed between the pivot axis and the distal end, and a drive pin slot disposed between the pivot axis and the proximal end, wherein the phase shifter arrangement has a drive shaft having a longitudinal axis and two drive pins, wherein the drive pins are disposed on opposite sides of the drive shaft at a lateral distance from the longitudinal axis of the drive shaft and mechanically coupled to the drive shaft by a plurality of struts, wherein each of the drive pins mechanically couples to a corresponding first wiper arm and second wiper arm of each of the pair of phase shifters, wherein as the drive shaft translates along the longitudinal axis, each drive pin slides within the drive pin slots of the corresponding first wiper arm and second wiper arm, causing the first wiper arm and second wiper arm to rotate in unison about their corresponding pivot axes.

7. The antenna of claim 6, wherein each first wiper arm has a first step feature disposed between its pivot axis and its drive pin slot, and each second wiper arm has a second step feature disposed between its pivot axis and its drive pin slot, wherein the second step feature is greater in height than the first step feature.

8. The antenna of claim 6, wherein each pivot axis is disposed substantially at a center of its corresponding first or second wiper arm.

9. The antenna of claim 6, wherein each of the first and second wiper arms comprise a distal hook structure, wherein each distal hook structure engages an edge of a corresponding PCB opening.

10. The antenna of claim 9, wherein each distal hook structure engages the edge of its corresponding PCB opening to apply sufficient pressure to electrically couple its corresponding conductive trace to a one or more phase shifter traces.

11. An antenna having an plurality of array faces, each of plurality of array faces corresponding to a distinct azimuth angle of coverage, each of the array faces comprising:

a PCB structure;

a plurality of radiators disposed on the PCB structure;

a phase shifter arrangement disposed on the PCB structure, the phase shifter arrangement having a pair of phase shifters, each of the phase shifters electrically coupled between one or more RF signal inputs and the plurality of radiators, each phase shifter having a first wiper arm and a second wiper arm, the first and second wiper arm each having a proximal end and a distal end and a pivot axis disposed between the proximal end and the distal end, the first and second wiper arm each having a wiper arm conductive trace disposed on its underside wherein the conductive trace is disposed between the pivot axis and the distal end, and a drive pin slot disposed between the pivot axis and the proximal end, wherein the phase shifter arrangement has a drive shaft having a longitudinal axis and two drive pins, wherein the drive pins are disposed on opposite sides of the drive shaft at a lateral distance from the longitudinal axis of the drive shaft and mechanically coupled to the drive shaft by a plurality of struts, wherein each of the drive pins mechanically couples to a corresponding first wiper arm and second wiper arm of each of the pair of phase shifters, wherein as the drive shaft translates along the longitudinal axis, each drive pin slides within the drive pin slots of the corresponding first wiper arm and second wiper arm, causing the first wiper arm and second wiper arm to rotate in unison about their corresponding pivot axes.

12. The antenna of claim 11, wherein each first wiper arm has a first step feature disposed between its pivot axis and its drive pin slot, and each second wiper arm has a second step feature disposed between its pivot axis and its drive pin slot, wherein the second step feature is greater in height than the first step feature.

13. The antenna of claim 11, wherein each pivot axis is disposed substantially at a center of its corresponding first or second wiper arm.

14. The antenna of claim 11, wherein each of the first and second wiper arms comprise a distal hook structure, wherein each distal hook structure engages an edge of an opening formed it its corresponding PCB structure.

15. The antenna of claim 14, wherein each distal hook structure engages the edge of its corresponding PCB opening to apply sufficient pressure to electrically couple its corresponding conductive trace to a one or more phase shifter traces.

16. The antenna of claim 11, wherein the antenna comprises three array faces, each spaced apart at 120 degrees of azimuth.

17. The antenna of claim 16, wherein each drive shaft is coupled to an individual motor, and wherein each drive shaft is driven independently.

18. The antenna of claim 16, wherein each of the drive shafts are mechanically coupled together and are driven by a single motor.

* * * * *